US008638269B2

(12) United States Patent
Cortes-Medellin

(10) Patent No.: US 8,638,269 B2
(45) Date of Patent: Jan. 28, 2014

(54) NON-PLANAR ULTRA-WIDE BAND QUASI SELF-COMPLEMENTARY FEED ANTENNA

(75) Inventor: German Cortes-Medellin, Ithaca, NY (US)

(73) Assignee: Cornell University, Ithaca, NY (US)

( * ) Notice: Subject to any disclaimer, the term of this patent is extended or adjusted under 35 U.S.C. 154(b) by 526 days.

(21) Appl. No.: 12/663,226

(22) PCT Filed: Jun. 5, 2008

(86) PCT No.: PCT/US2008/065950

§ 371 (c)(1), (2), (4) Date: Apr. 27, 2010

(87) PCT Pub. No.: WO2008/154305

PCT Pub. Date: Dec. 18, 2008

(65) Prior Publication Data

US 2010/0207836 A1 Aug. 19, 2010

Related U.S. Application Data

(60) Provisional application No. 60/942,366, filed on Jun. 6, 2007.

(51) Int. Cl.
*H01Q 11/10* (2006.01)

(52) U.S. Cl.
USPC ..... 343/792.5

(58) Field of Classification Search
USPC ..... 343/702, 810–811, 792.5, 700 MS
See application file for complete search history.

(56) References Cited

U.S. PATENT DOCUMENTS

| | | | | |
|---|---|---|---|---|
| 3,641,579 | A * | 2/1972 | Voronoff | 343/792.5 |
| 4,228,437 | A * | 10/1980 | Shelton | 343/909 |
| 4,499,473 | A * | 2/1985 | Rao | 343/754 |
| 4,594,595 | A * | 6/1986 | Struckman | 343/770 |
| 5,220,337 | A * | 6/1993 | Ajioka | 343/770 |
| 5,274,390 | A * | 12/1993 | Breakall | 343/792.5 |
| 5,457,465 | A * | 10/1995 | Collier et al. | 342/374 |
| 5,952,982 | A * | 9/1999 | Jorgenson et al. | 343/792.5 |
| 6,094,176 | A * | 7/2000 | Van Hoozen et al. | 343/792.5 |
| 6,211,839 | B1 * | 4/2001 | Campbell | 343/792.5 |
| 6,731,248 | B2 * | 5/2004 | Killen et al. | 343/792.5 |
| 6,734,827 | B2 * | 5/2004 | Killen et al. | 343/792.5 |
| 6,946,990 | B2 * | 9/2005 | Monk | 342/174 |
| 7,030,831 | B2 * | 4/2006 | Nilsson | 343/840 |

(Continued)

OTHER PUBLICATIONS

G. R. Harp, et al.; Primary Beam and Dish Surface Characterization at the Allen Telescope Array by Radio Holography; IEEE Transactions on Antennas and Propagation, Jun. 2011, vol. 59, No. 6, pp. 2004-2021.

*Primary Examiner* — Huedung Mancuso
(74) *Attorney, Agent, or Firm* — Miller, Matthias & Hull LLP

(57) ABSTRACT

A non-planar, ultra-wide band, quasi-self-complementary feed antenna is disclosed. The antenna provides an invariant phase center location over its entire frequency band, is compact and includes a low profile, and includes input matching better than is currently available over a decade of frequency bandwidth. The very compact feed couples dual polarization electromagnetic energy to a transmitter from free space or air with minimum losses and mismatches over a very wide frequency band.

21 Claims, 12 Drawing Sheets

(56) References Cited

U.S. PATENT DOCUMENTS

| | | | | |
|---|---|---|---|---|
| 7,215,292 | B2 * | 5/2007 | McLean | 343/725 |
| 7,259,725 | B2 * | 8/2007 | Wang et al. | 343/792.5 |
| 7,286,095 | B2 * | 10/2007 | Parsche et al. | 343/773 |
| 7,755,557 | B2 * | 7/2010 | McGonigle et al. | 343/786 |
| 2004/0075615 | A1 * | 4/2004 | Engargiola et al. | 343/810 |
| 2004/0130488 | A1 * | 7/2004 | De Champlain | 342/374 |
| 2005/0057411 | A1 * | 3/2005 | Apostolos | 343/744 |
| 2005/0212714 | A1 * | 9/2005 | Chiang et al. | 343/810 |
| 2005/0248499 | A1 * | 11/2005 | Park et al. | 343/895 |
| 2006/0028388 | A1 * | 2/2006 | Schantz | 343/770 |
| 2006/0071864 | A1 * | 4/2006 | Richard et al. | 343/702 |
| 2008/0204343 | A1 * | 8/2008 | Kildal | 343/792.5 |

* cited by examiner

NON-PLANAR ULTRA-WIDE BAND QUASI SELF-COMPLEMENTARY FEED ANTENNA

CROSS-REFERENCE TO RELATED APPLICATIONS

This application is a U.S. National Stage filing under 35 U.S.C. §371 of International Patent Application No. PCT/US08/65950 filed on Jun. 5, 2008, which claims priority under the Paris Convention to U.S. Provisional Patent Application No. 60/942,366 filed on Jun. 6, 2007.

FEDERAL FUNDING

This invention was made with government support under contract number 0431904 awarded by NSF. The government has certain rights in the invention.

FIELD OF THE DISCLOSURE

The present disclosure relates to antennas for transmission and reception of electromagnetic energy and, more particularly, to non-planar ultra-wide band antennas.

BACKGROUND OF THE INVENTION

Within the radio astronomic community there is a growing interest on very wide band receiver systems capable of operating with high levels of sensitivity and at the very low noise characteristics of modern radio astronomic instruments. These new instruments will allow observation of astronomical sources from the boundary between the dark universe and that of the first galaxy formation to study very fast astronomical phenomena. In order to do this, these new classifications of instruments require an ideally instantaneous bandwidth from 100 MHz and 25 GHz. For example, this is the aim of the international collaboration known as the Square Kilometer Array (SKA). Therefore the need for ultra-wide band radio telescope systems is very pressing.

Currently there are receiver systems with noise temperatures of a few degrees Kelvin operating over a decade of bandwidth. In addition, radio telescope arrays such as the Allen Telescope Array (ATA) currently being completed at Berkeley operates with such low noise receiver systems in conjunction with an off-axis Gregorian reflector optics and an ultra wide feed that operates from 0.5 to 12 GHz. While the ATA feed has good input matching over a very wide frequency band, nevertheless, it also has two main drawbacks. One drawback is its relatively large aspect ratio, i.e., the ratio of its width dimension to its height dimension, and the second is the location of the phase center of the feed varies as a function of frequency. Accordingly, current receiver systems cannot take full advantage of their large bandwidth with the highest sensitivity for simultaneous observations using the full bandwidth, or in the alternative has to be limited to a narrower bandwidth with the aid of a motorized re-focusing mechanism.

One alternative wideband feed is the Chalmers Feed which is a low profile feed and also has a frequency invariant phase center location. However, a major disadvantage of the Chalmers Feed is somewhat poor input matching (currently, at some frequencies within the frequency band only better than −7 dB) that reduces its effective frequency band coverage.

Based on the foregoing it can be seen that a need exists for an ultra-wide band antenna which has a phase center which is invariant to frequency, which is compact and has a low profile, and which has an input matching better than what is currently known.

SUMMARY OF THE INVENTION

In accordance with one aspect of the disclosure, there is provided a low profile and compact non-planar ultra-wide band antenna. The antenna comprises a conducting disk; a plurality of feed veins extending radially outward from a center of the conducting disk, each feed vein increasing in cross-sectional size in the radial direction; and, a plurality of fingers extending from each feed vein from alternating sides of the feed vein.

In accordance with another aspect of the disclosure, there is provided a low profile and compact non-planar ultra-wide band antenna with a phase center location invariant to frequency. The antenna comprises a conducting disk; a plurality of feed veins extending radially outward from a center of the conducting disk, each feed vein increasing in cross-sectional size in the radial direction; and, a plurality of fingers extending from each feed vein from alternating sides of the feed vein.

In accordance with another aspect of the disclosure, there is provided a low profile and compact non-planar ultra-wide band antenna. The antenna comprises a conducting disk with a diameter that is approximately $1.2\lambda_{max}$; a plurality of feed veins radially extending outward from the center of the conducting disk inclined at an angle creating an antenna height of approximately $0.25\lambda_{max}$; and, a plurality of fingers extending from each vein from alternating sides of the feed vein. Here, the value $\lambda_{max}$ is the wavelength at the lowest operating frequency.

In accordance with another aspect of the disclosure, there is provided a low profile and compact non-planar ultra-wide band antenna with input matching better than −11 dB over a decade of frequency bandwidth. The antenna comprises a conducting disk; a plurality of feed veins radially extending outward from the center of the conducting disk allowing return currents for better input matching over the frequency band; and, a plurality of fingers extending from each feed vein from alternating sides of the feed vein.

These and other aspects in this disclosure will become more readily apparent upon reading the following detailed description when taken in conjunction with the accompanying drawings.

Figure 1:
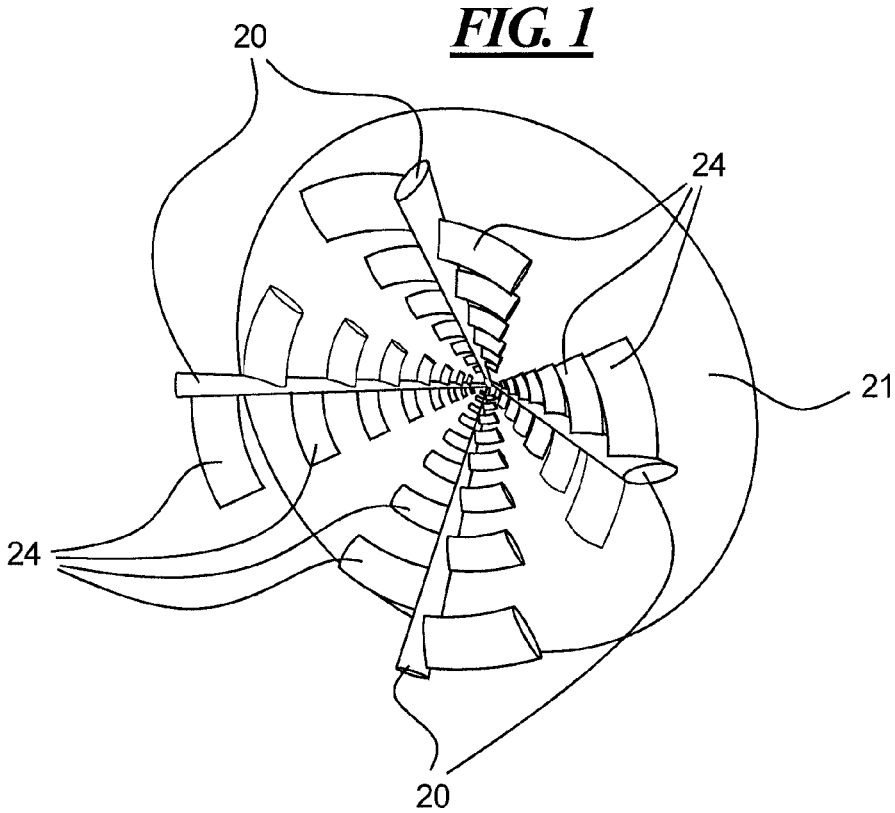
FIG. 1 is a perspective view of an antenna constructed in accordance of the teachings of this disclosure.

While the present disclosure is susceptible to various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions, and equivalents falling with the scope of the present invention.

DETAILED DESCRIPTION

As shown in FIG. 1, in one embodiment of the disclosed invention, the antenna has four arms or feed veins 20 with a three-dimensional (3-D) log periodic configuration and a quasi self-complementary structure (i.e., is not strictly a 3-D self-complementary structure, but its projection to a plane parallel to a ground plane is self-complementary). The antenna has four-fold azimuth symmetry, (i.e., its aspect ratio remains invariant to rotations of 90°). As will be described in further detail herein, the antenna structure further includes a conducting disk 21 within the ground plane with a plurality of wires or coaxial input connectors 22 attached to the feed veins 20 at the vein tips 23.

The feed veins 20 are located over the conducting disk 21 with an inclination angle that may be optimized to minimize cross-polarization. While the diameter of the conducting disk 21 is dependent on the operating frequency, it has a thickness enough to give structural support to the overall feed assembly. The antenna is dual polarized with single linear polarization being achieved by exciting two opposing feed veins 20.

In terms of size, the antenna is very compact with a diameter of approximately $1.2\lambda_{max}$ by $0.25\lambda_{max}$ in height, where $\lambda_{max}$ is the wavelength at the lowest operating frequency. Furthermore, a plurality of fingers 24 alternatively extends from each side of the feed veins 20. The 3-D shape and position of the plurality of fingers 24 are carefully chosen to minimize return loss over the frequency band.

Figure 2:
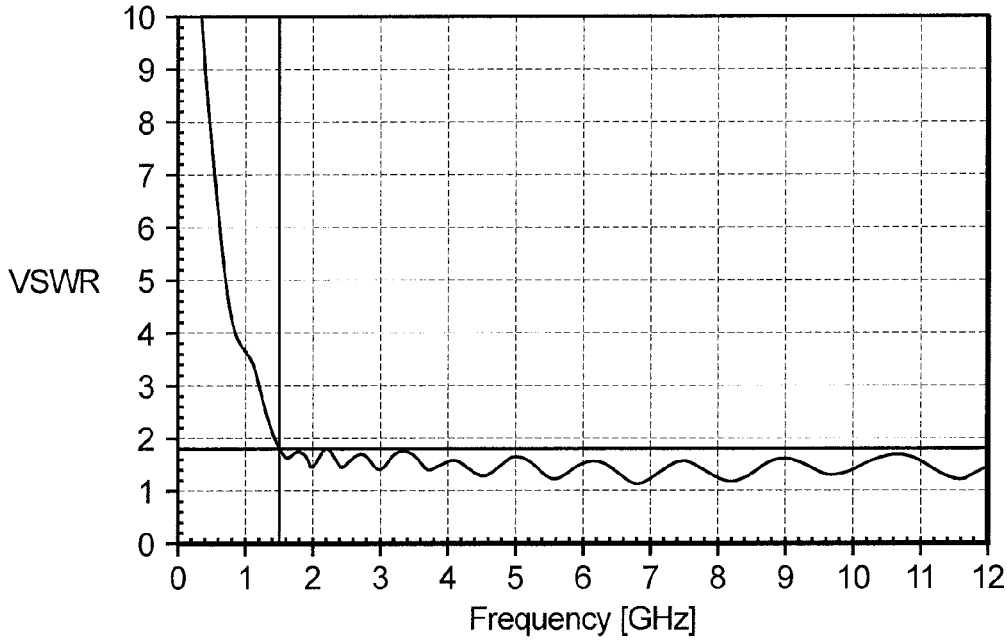
FIG. 2 is a graph depicting typical feed voltage standing wave ratio (VSWR) as a function of frequency.

The performance of this antenna was calculated numerically in terms of input matching and far field radiation patterns. The calculated feed input matching, given in terms of VSWR, is shown in FIG. 2. The maximum VSWR value is 1.8:1 over the frequency band. The input impedance is quite high but manageable (260Ω).

Figure 3:
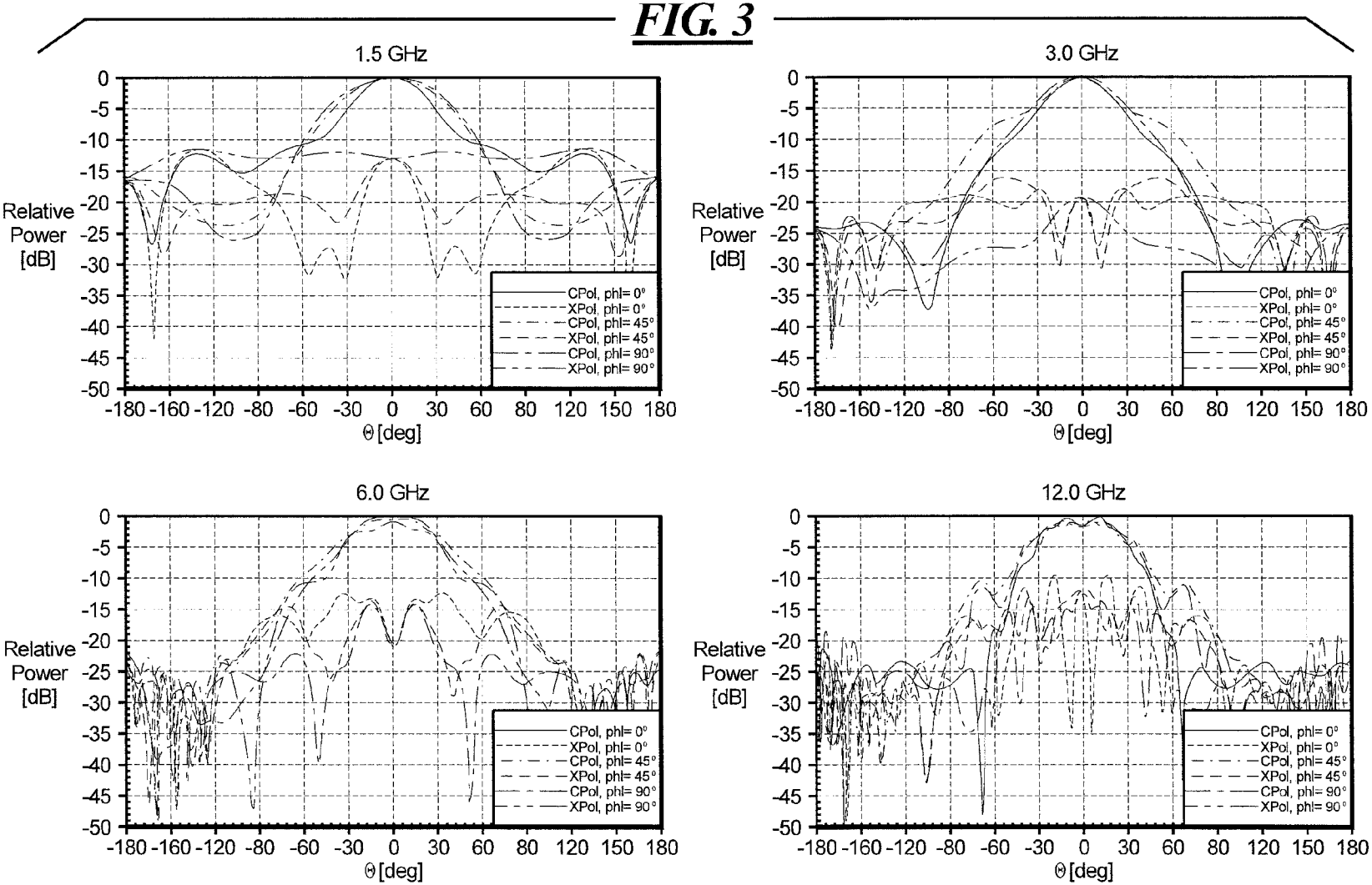
FIG. 3 is a series of graphs depicting typical feed co-polar and cross-polar pattern cuts at 0°, 45° and 90° for four different frequencies.

FIG. 3 depicts the calculated co-polar and cross-polar pattern cuts for the antenna at $\phi$=0°, 45° and 90° for four different frequencies, namely, 1.5 GHz, 3 GHz, 6 GHz and 12 GHz, respectively. The calculated frequency average −10 dB half beam width is approximately 68°.

Figure 4:
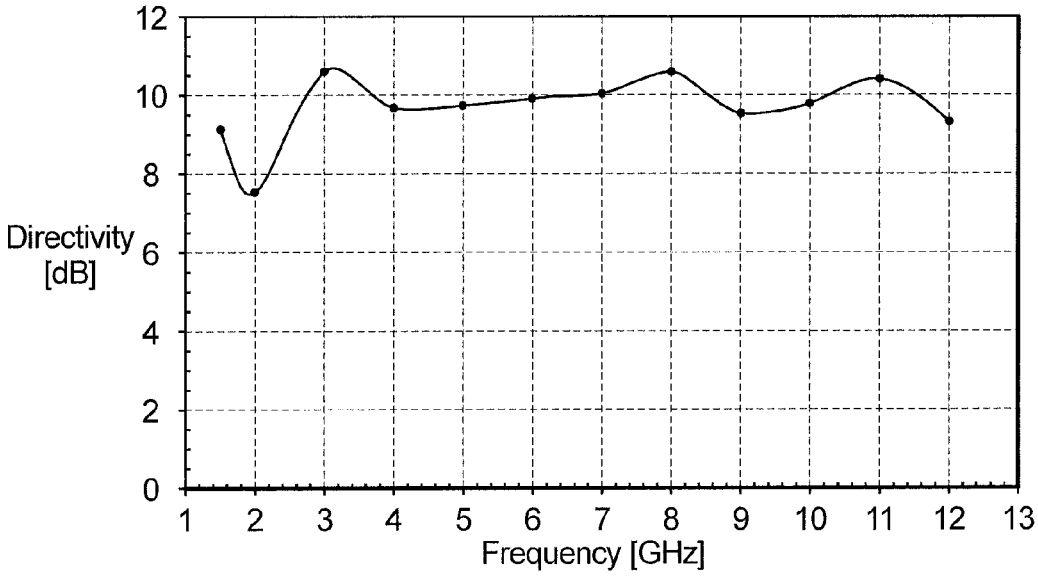
FIG. 4 is a graph depicting calculated antenna directivity as a function of frequency.
Figure 5:
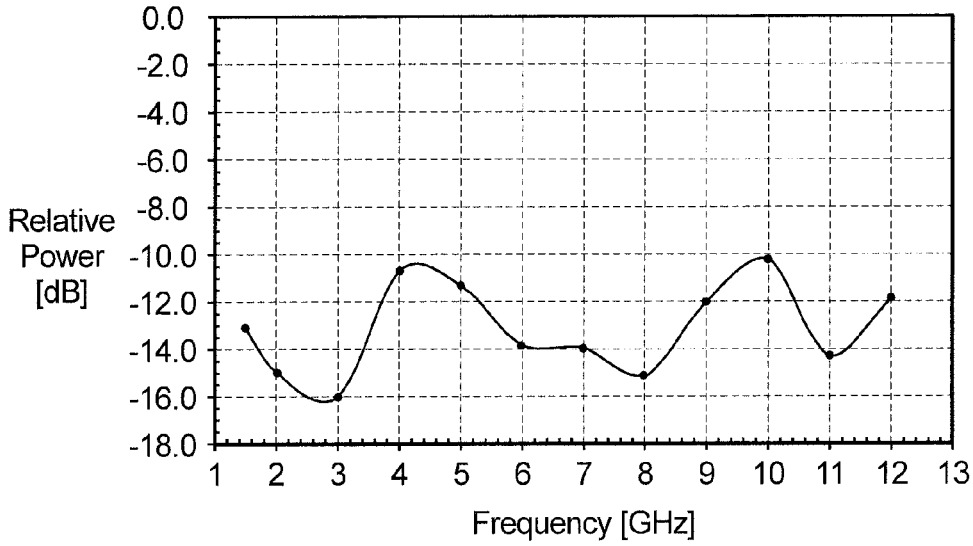
FIG. 5 is a graph depicting peak values of cross-polarization at an angle of 45°.

In FIG. 4, the calculated antenna directivity is shown as a function of frequency. The antenna has very good polarization characteristics, with cross-polarization peak values at 45° better than −10 dB over the frequency band shown in FIG. 5.

The result of the foregoing is a non-planar, ultra-wide band antenna in a quasi self-complementary configuration. The antenna operation has been simulated and detailed information has been obtained about the far field radiation patterns of the feed, input matching, directivity, beam width, and polarization characteristics over ranges from 1.5 to 12 GHz. The disclosure therefore provides a compact antenna that couples dual polarization electromagnetic energy from (to) a transmitter (receiver) to (from) free space or air, with minimum losses and mismatch (better than 10 dB return loss), over a very wide (≥10:1) frequency bandwidth while manifesting a phase center location that is invariant over the frequency band.

Certain unique features of the disclosure include the following:

- A non-planar quasi self-complementary structure;
- A decade of operating frequency bandwidth, (1:10);
- A low profile of approximately $1.2\lambda_{max}$ diameter and $0.25\lambda_{max}$ height, where $\lambda_{max}$ is the wavelength at the lowest operating frequency;
- The feed veins 20 have a 3-D vein structure with a cross-section that grows in the radial direction;
- The ground plane is a conducting disk 21 with a diameter of approximately $1.2\lambda_{max}$, where $\lambda_{max}$ is the wavelength at the lowest operating frequency, and enough thickness to give structural support to the overall antenna;
- The fingers 24 are extended from each feed vein 20 from alternating sides of and along the 3-D feed vein 20;
- The phase center location is frequency invariant over the operating frequency band;
- The input return losses are better than 10 dB over the bandwidth; and
- The antenna has dual polarization (linear or circular).

The antenna has very good cross-polarization (better than 13 dB in average)

Figure 6:
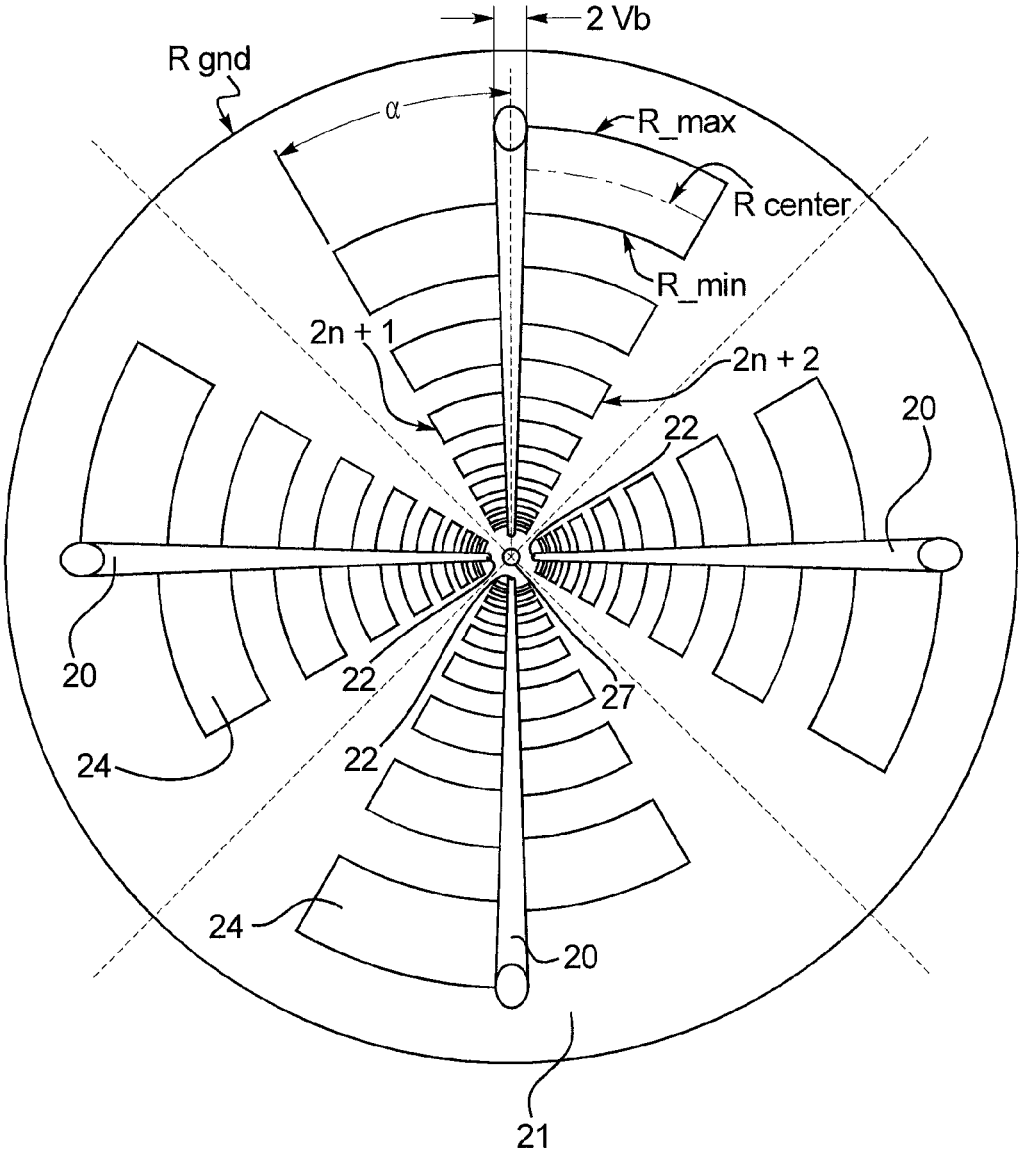
FIG. 6 is a plan view of the antenna of FIG. 1.

Referring to FIG. 6, the height and radial locations of the fingers 24 with respect to the conducting disk 21 are given by, $$\rho_k = r_k \cos\beta \tag{1}$$

$$h_k = r_k \sin\beta + h_o \tag{2}$$

Figure 7:
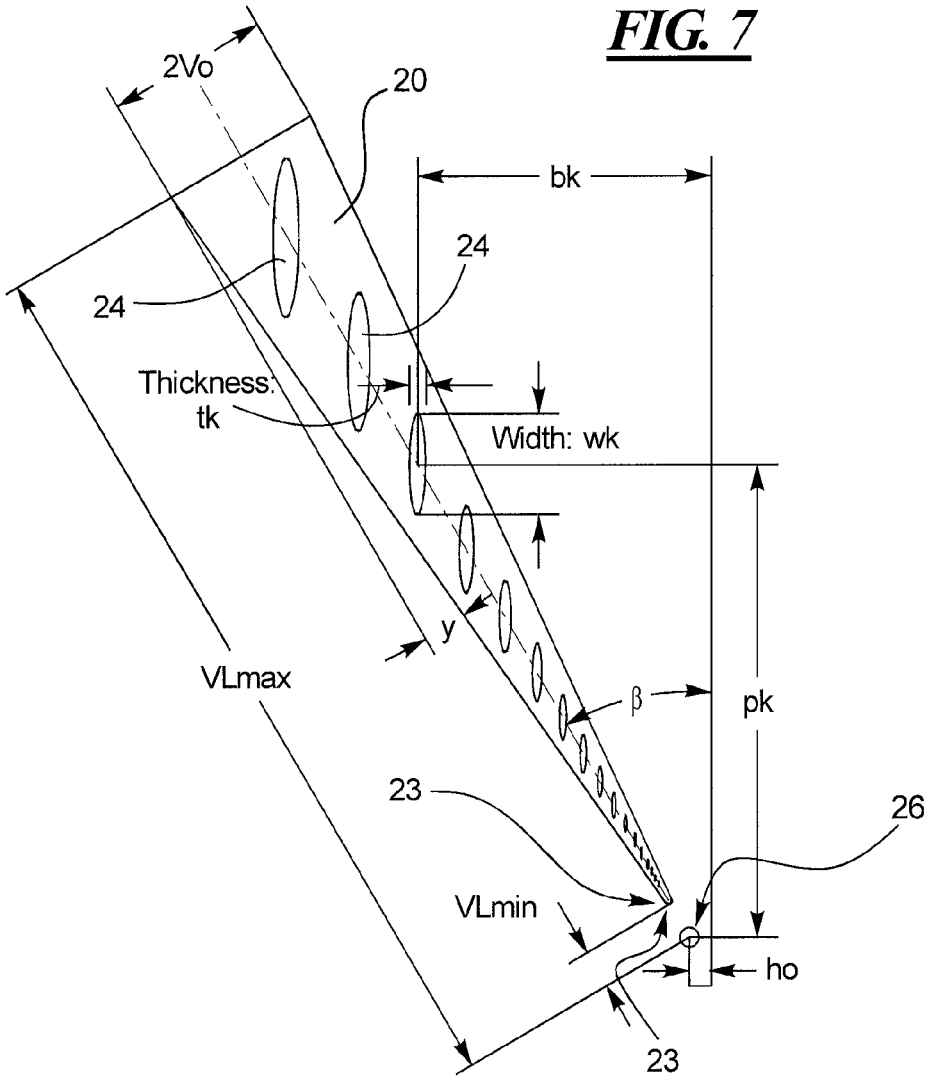
FIG. 7 is a cross-sectional view of one of the radial feed veins of the antenna depicted in FIGS. 1 and 6.
Figure 8:
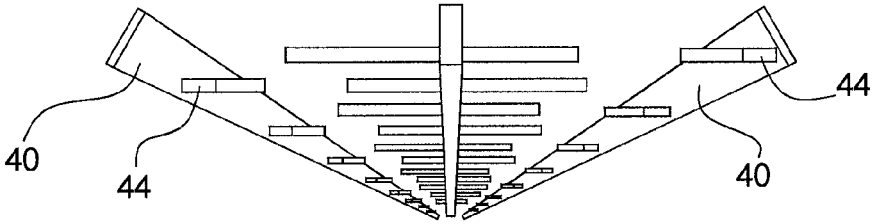
FIG. 8 is a cross-sectional view of an alternative embodiment depicting an antenna having flat surface faces and rectilinear cross-sections for the fingers and feed veins.

Where, $h_o$ is the distance from the vertex 26 to the ground plane, as shown in FIG. 7.

The width and thickness of the fingers 24 are given by, $$\omega_k = a_k - a_{k-1} \tag{3}$$

$$t_k = \xi\omega_k \tag{4}$$

With, $\xi = 1/3$ typically and, $$\varpi_0 = \frac{\Delta}{4}\frac{4x_o + \Delta}{(2x_o + \Delta)} \tag{5}$$

Also, $$r_k = \frac{a_k + a_{k-1}}{2} \tag{6}$$

$$r_0 = \frac{1}{2}\left(2x_o - \frac{\Delta}{2} + \frac{x_o\Delta}{2x_o + \Delta}\right) \tag{7}$$

Now the values of $a_k$ are given by, $$a_k = \frac{2x_k x_{k+1}}{x_k + x_{k+1}} \tag{8}$$

With, $$x_{2n+1} = x_{2n} + \frac{\Delta}{\tau^n} \tag{9}$$

$$x_{2n+2} = x_{2n+1} + \frac{\Delta}{\tau^n} \tag{10}$$

Where, $x_o$, $\Delta$, and $\tau$ are input parameters.

The feed vein 20 structure may be in the form of a truncated cone with an elliptical cross-section that grows in the radial direction. Each feed vein 20 is inclined by an angle $\beta$ of normally 30° (but it may vary), with its largest cross-section orientated vertically with respect to the conducting disk 21. The smallest point of each feed vein 20, or vein tip 23, is connected to a wire or coaxial connector 22 at the center 27 of the ground plane structure.

The feed vein 20 parameters of the embodiment of FIG. 1 are given by:

$$VL_{max} = x_M + \omega_M \tag{11}$$

$$V_a = \omega_M \tag{12}$$

$$V_b = \xi\omega_M \tag{13}$$

$$V_0 = \omega_0 \tag{14}$$

Where M is the total number (even or odd) of fingers 24, $V_a$ and $V_b$ are the respective major and minor axes of the external cross-section of the feed vein 20, and $V_0$ is the cross-sectional diameter of the vein tip 23.

The geometry of the feed veins 20 is determined by these parameters: $VL_{min}$, $x_o$, $\Delta$, $\tau$, $\xi$, $\beta$, $\alpha$, $h_o$, M, and the over scale $s_o$. A value of M=18 gives a 10:1 frequency coverage and increasing M will increase its frequency ratio of operation, which is limited only by fabrication constraints.

Referring now to FIGS. 8-18, seven additional alternative embodiments of the present disclosure are depicted. In the first alternative embodiment of FIG. 8, the structure is substantially the same as that of the antenna depicted above in FIG. 1, but for the provision of the rectilinear feed veins 40 and fingers 44 which have rectilinear cross-sections.

Figure 9:
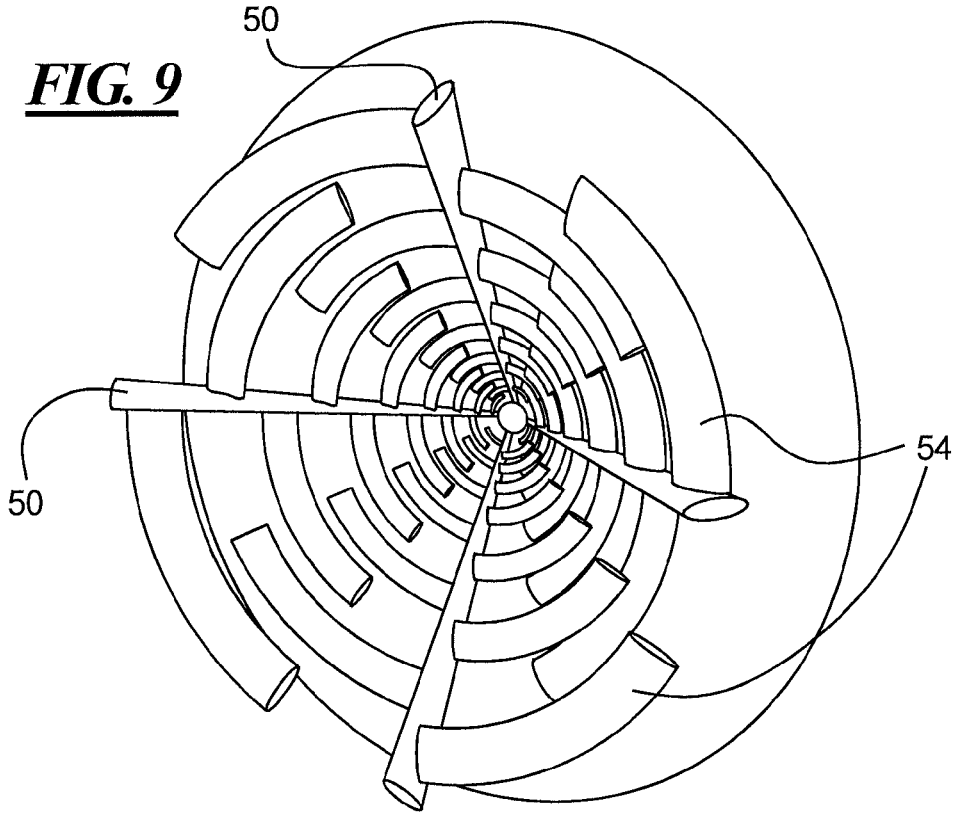
FIG. 9 is perspective view of another alternative embodiment depicting interweaved fingers.

The structure of the embodiment of FIG. 9 is also substantially similar to the first embodiment. However, the structure of FIG. 9 includes interleaved fingers 54 attached to each adjacent feed vein 50.

Figure 10:
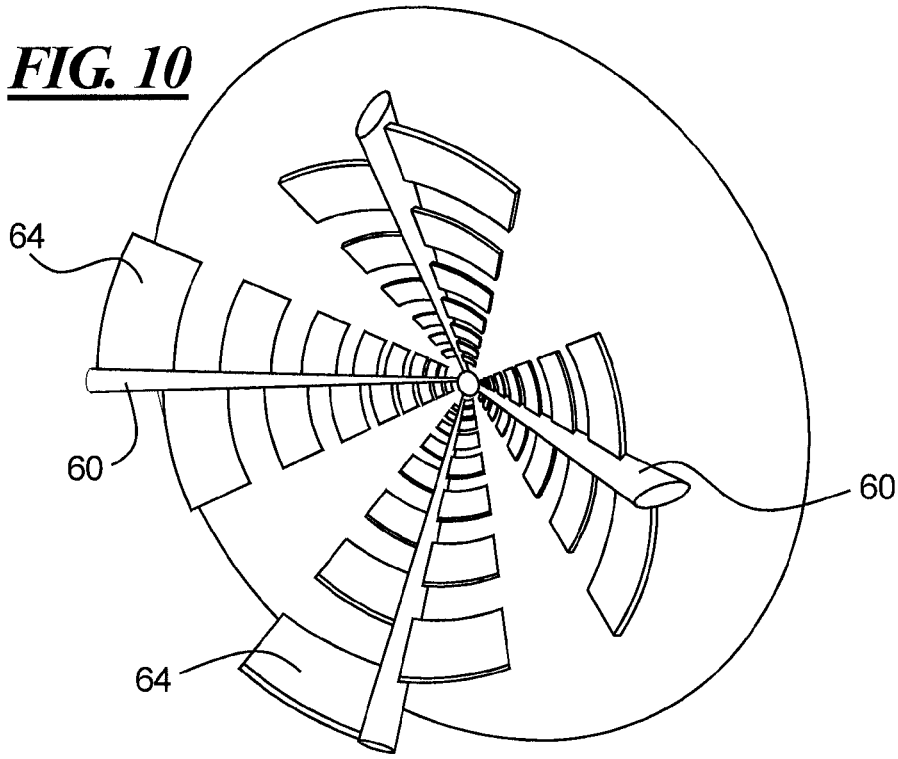
FIG. 10 is a perspective view of another alternative embodiment of an antenna constructed in accordance with the teachings of the disclosure and with feed veins made of conducting laminate rolled out in the form of a cone surface.

The structure of the embodiment of FIG. 10 is also substantially similar to the first embodiment but for the laminated feed veins 60 and fingers 64 being made of a conducting laminate rolled out in the form of a conical surface.

Figure 11:
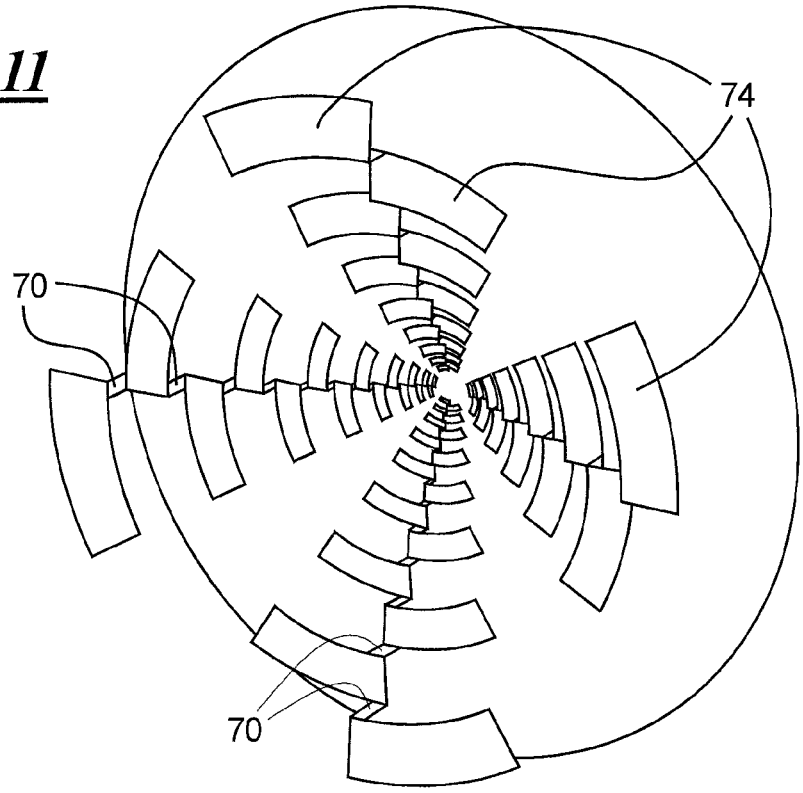
FIG. 11 is a perspective view of another alternative embodiment of an antenna constructed in accordance with the teachings of the disclosure and with feed veins made of conducting laminate with bents and stepped circular fingers.
Figure 12:
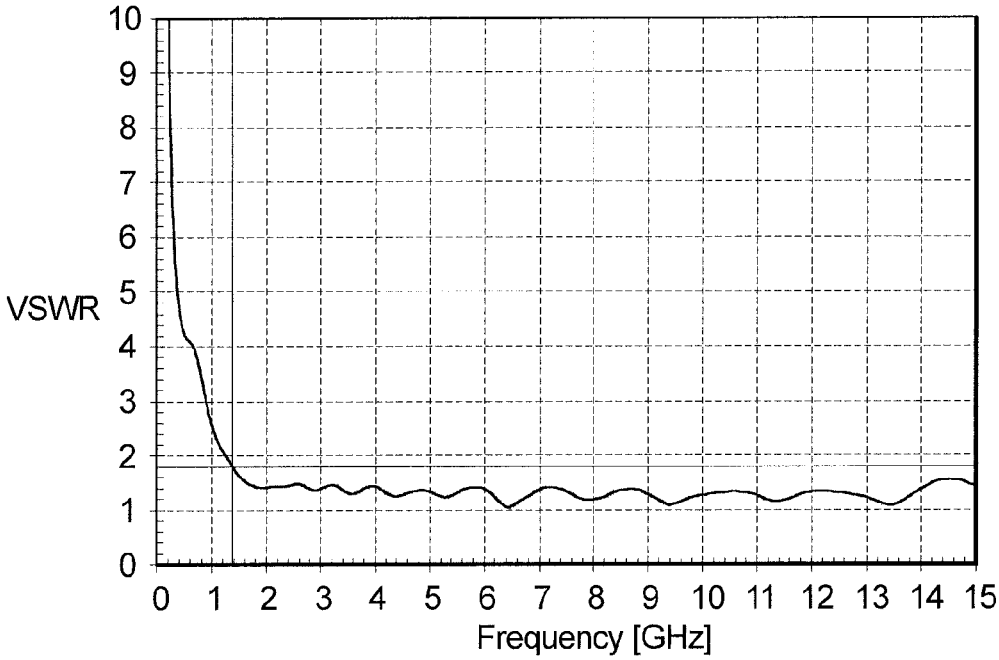
FIG. 12 is a graph showing the performance of the antenna of FIG. 11 in terms of calculated VSWR with respect to frequency response.

The structure of the embodiment of FIG. 11 is substantially similar to the first embodiment with the provision of stepped circular fingers 74 and bent feed veins 70 made with a conducting laminate of a given thickness with bends forming steps that provide the correct locations for the stepped circular fingers 74. In this structure, the bent feed veins 70, when seen from the top, have the same increase in width in the outward radial direction as the first embodiment. FIG. 12 shows the calculated performance of this laminated embodiment, in terms of VSWR. The fabrication of the laminated stepped circular fingers 74 in this embodiment is made by standard sheet metal techniques of laser cutting of a laminate or by chemical etching. Once the flat bent feed vein 70 patterns are cut, the structure is then bent at specified points into the final 3-D form.

Figure 13:
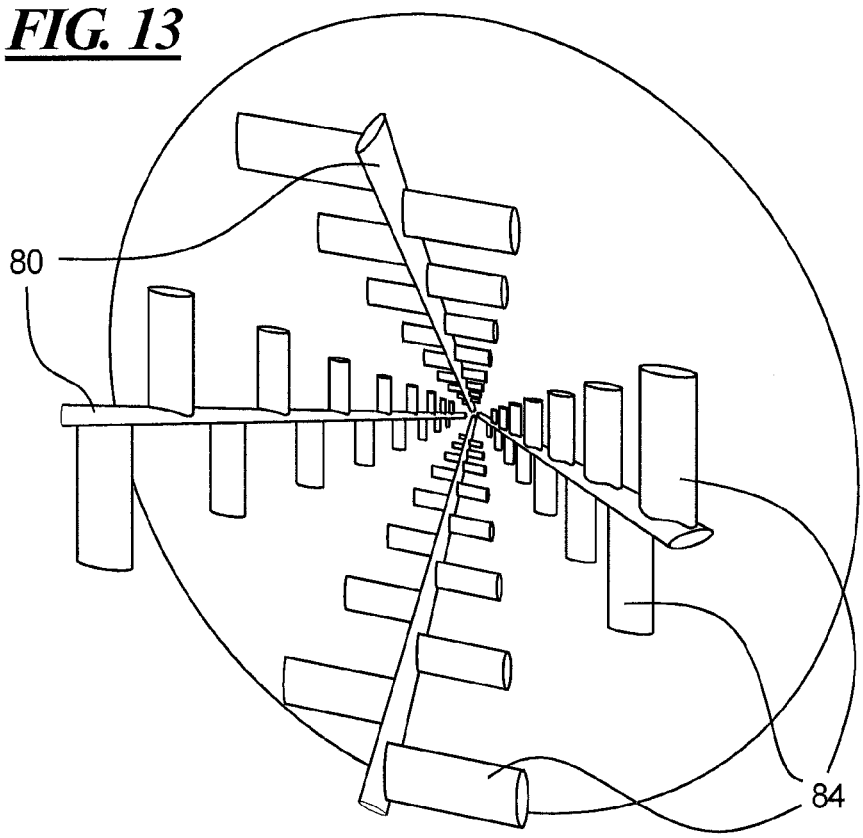
FIG. 13 is a perspective view of another alternative embodiment of an antenna constructed in accordance with the teachings of the disclosure and depicting straight fingers with quadratic cross-sections perpendicular to the feed veins.
Figure 14:
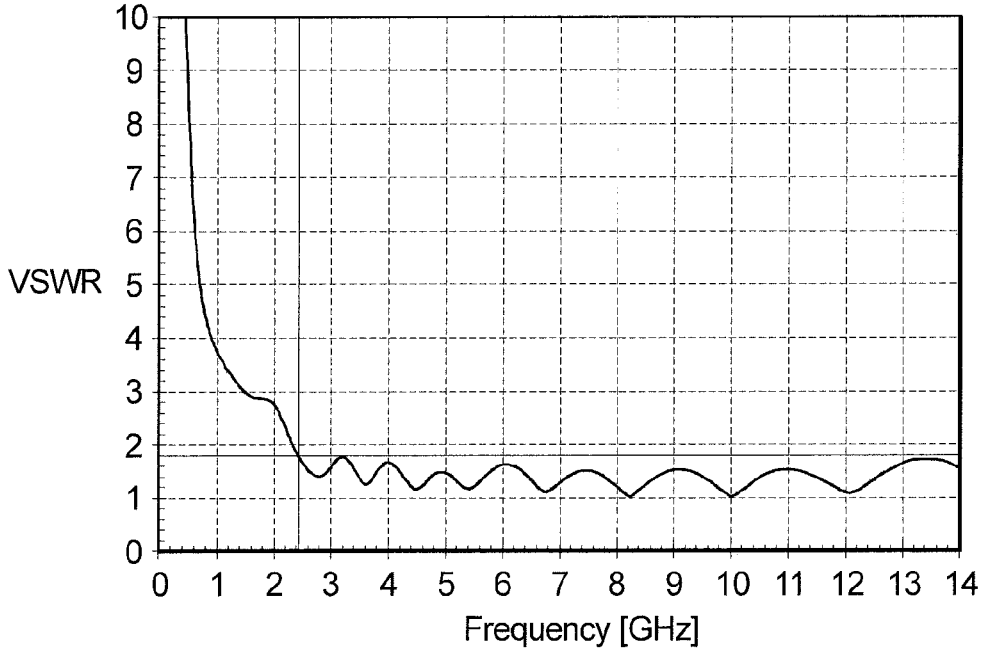
FIG. 14 is a graph showing typical performance of the antenna of FIG. 13 in terms of calculated VSWR with respect to frequency response.

The structure of the embodiment of FIG. 13 is substantially similar to the first embodiment with the provision of straight fingers 84 with elliptical cross-sections instead of circular fingers 24 with elliptical cross-sections. The location and orientation of the straight fingers 84 along the feed veins 80 are the same as in the first embodiment as they are described by the same equations presented herein. FIG. 14 shows the calculated performance of this embodiment, in terms of VSWR for this embodiment.

Figure 15:
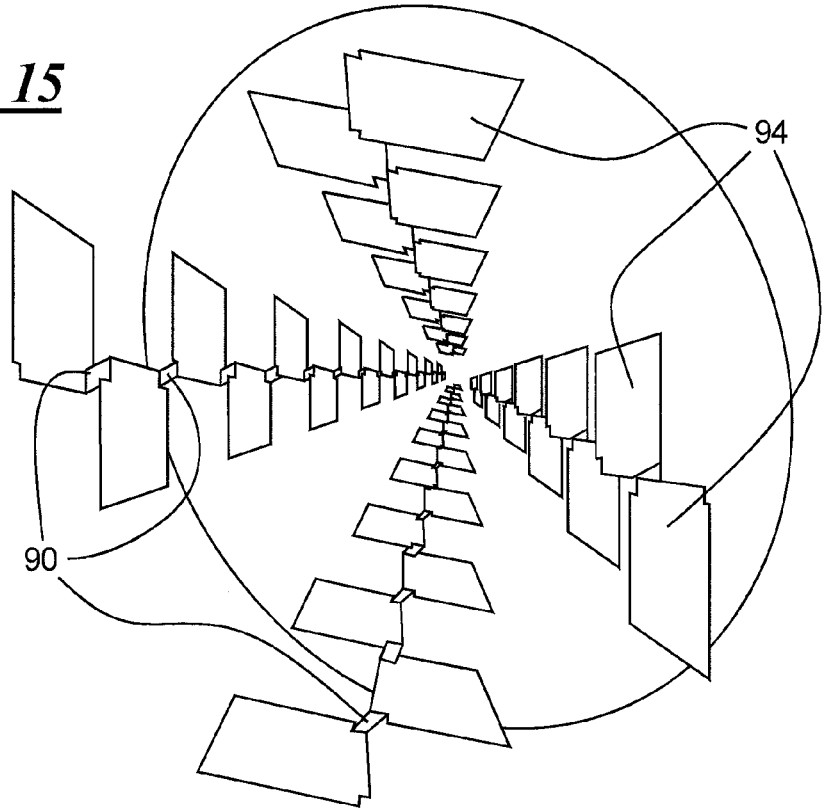
FIG. 15 is a perspective view of another alternative embodiment of an antenna constructed in accordance with the teachings of the disclosure and with feed veins made of conducting laminate with bents and stepped straight fingers.
Figure 16:
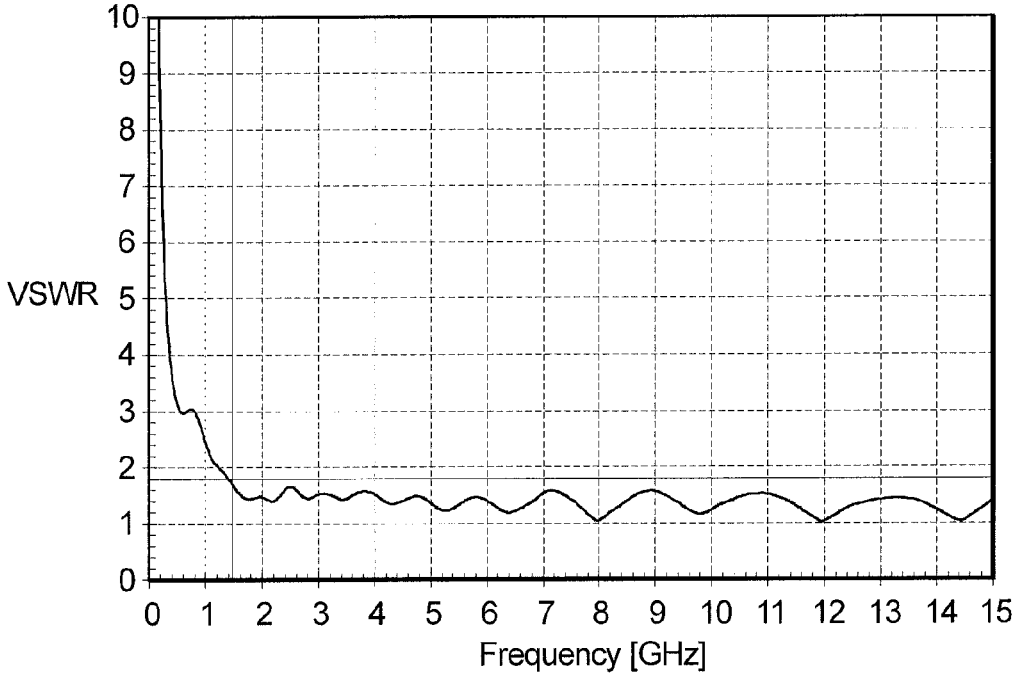
FIG. 16 is a graph showing typical performance of the antenna of FIG. 15 in terms of calculated VSWR with respect to frequency response.

The structure of the embodiment of FIG. 15 is substantially similar to the first embodiment with the provision of the stepped straight fingers 94 and bent feed veins 90 made with a conducting laminate of a given thickness with bends forming steps that provide the correct location for the stepped straight fingers 94. Also, in this structure, the bent feed veins 90, when seen from the top, have the same increase in width in the outward radial direction as the first embodiment. FIG. 16 shows the calculated performance of this laminated embodiment, in terms of VSWR for this embodiment.

Figure 17:
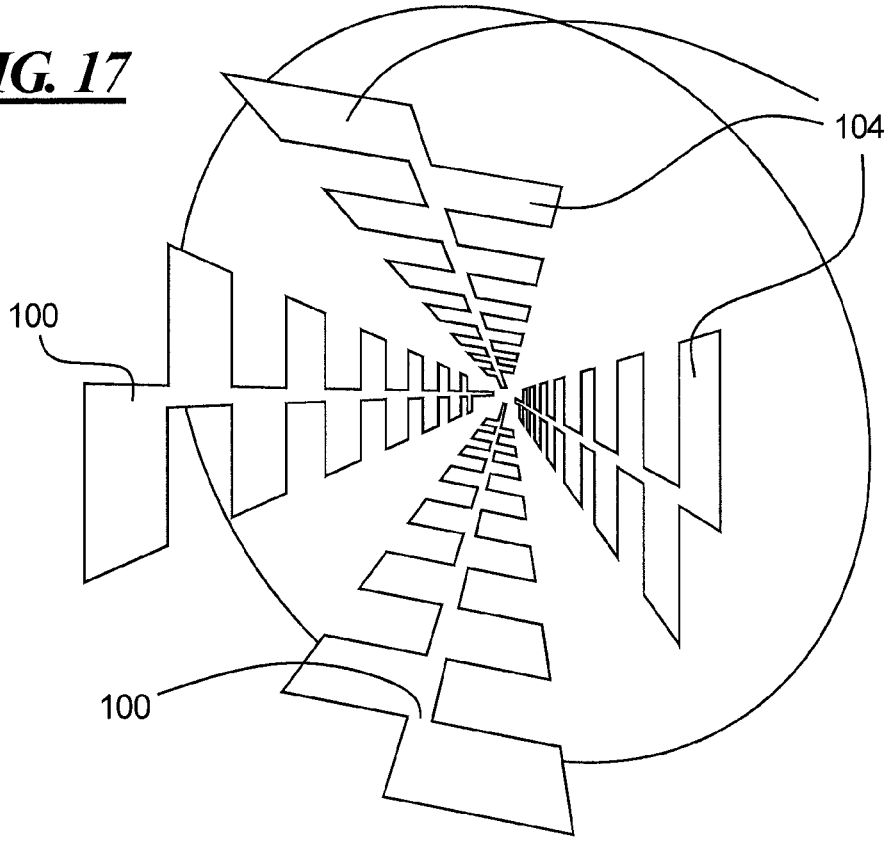
FIG. 17 is a perspective view of another alternative embodiment of an antenna constructed in accordance with the teachings of the disclosure and with feed veins made of conducting laminate with flat straight fingers in the plane of the feed vein.
Figure 18:
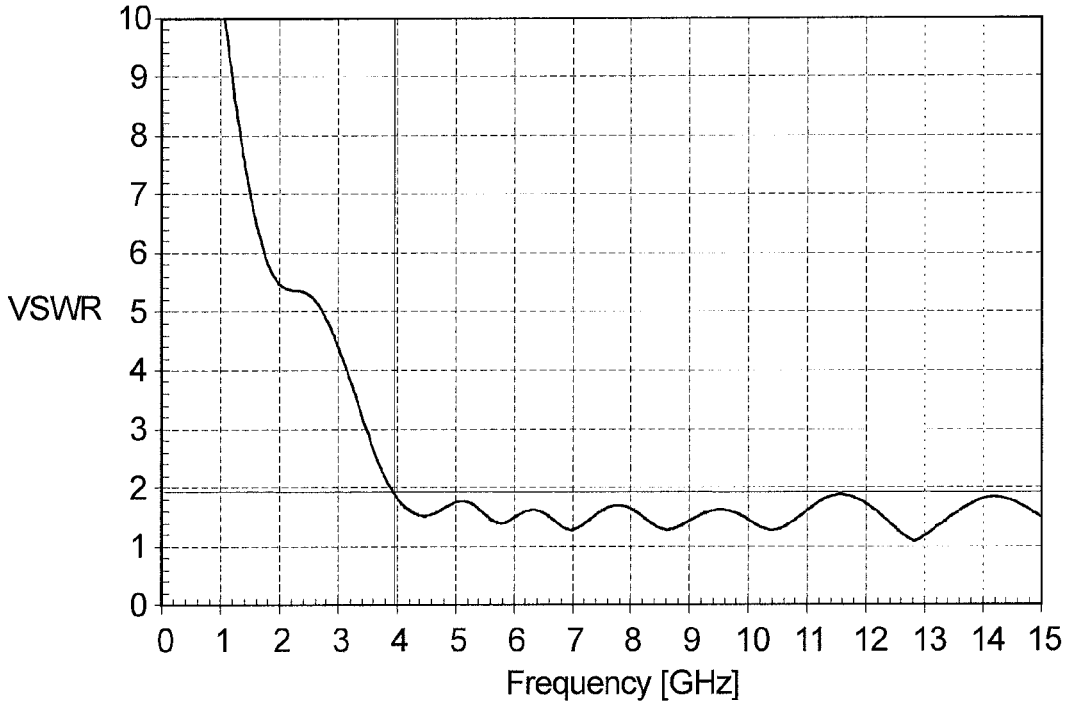
FIG. 18 is a graph showing typical performance of the antenna of FIG. 17 in terms of calculated VSWR with respect to frequency response.

In still a further embodiment, the structure of FIG. 17 is substantially similar to the first embodiment with the provision of having laminated flat straight fingers 104 sharing the same plane as the laminated feed veins 100. The inclination angle of the straight finger 104 section with respect to the ground plane is the same as that of the laminated feed vein 100 with respect to the ground plane. The location and dimensions of the straight fingers 104 are the same as in the first embodiment and described by the same design equations presented in the disclosure. FIG. 18 shows the calculated performance of this laminated embodiment, in terms of VSWR for this embodiment. The fabrication of these laminated versions of the first embodiment is made by standard sheet metal techniques of laser cutting of a laminate or by chemical etching.

Figure 19:
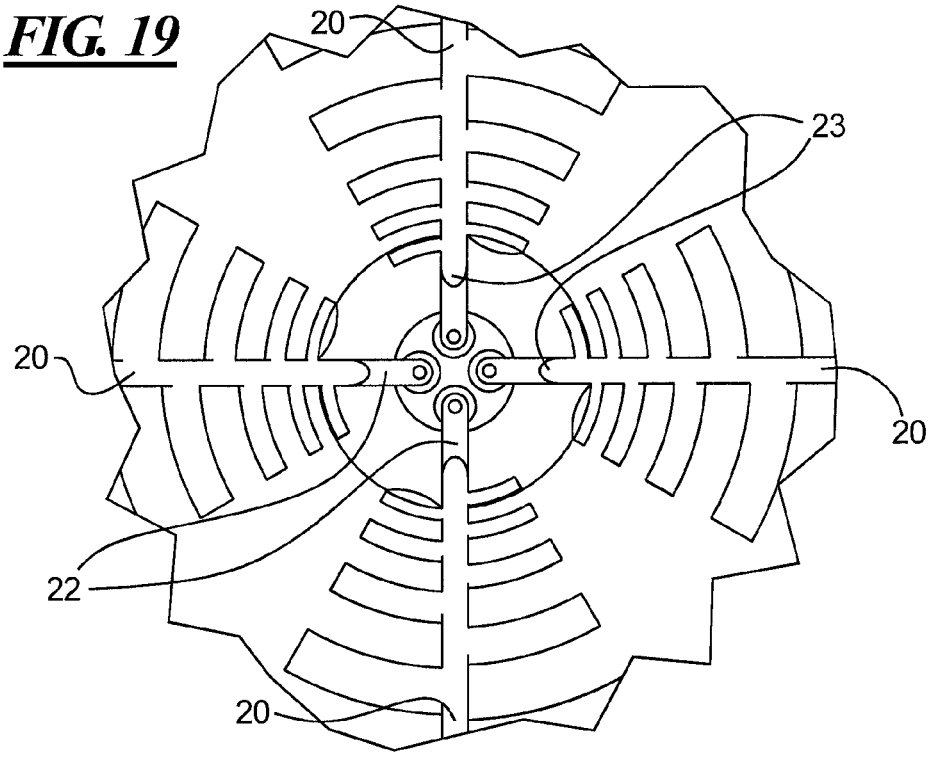
FIG. 19 is a plan view of an input connector of an antenna constructed in accordance with the teachings of the disclosure.

In order to make and use the antennas disclosed herein, a milling machine may be used to fabricate the fingers 24 for low frequencies. For higher frequencies, a Wire-EDM (Electrostatic Discharge Manufactures) may be used to create the very fine details since surface contours require it. A low loss material such as fiber glass post or polyurethane foam may be used as support. In the embodiments disclosed, four wires or coaxial cables with common ground are used as input but in other embodiments, a greater or lesser number of wires or coaxial cables may be employed. As shown in FIG. 19, the center of each wire or coaxial cable is connected to a vein tip 23 of each feed vein 20 using an input connector 22. An active or passive balun may be used for connection to the receiver or transmitter. The feed may be used as a prime focus feed in conjunction with a parabolic reflector system or separate feed with very wide angular coverage.

Figure 20:
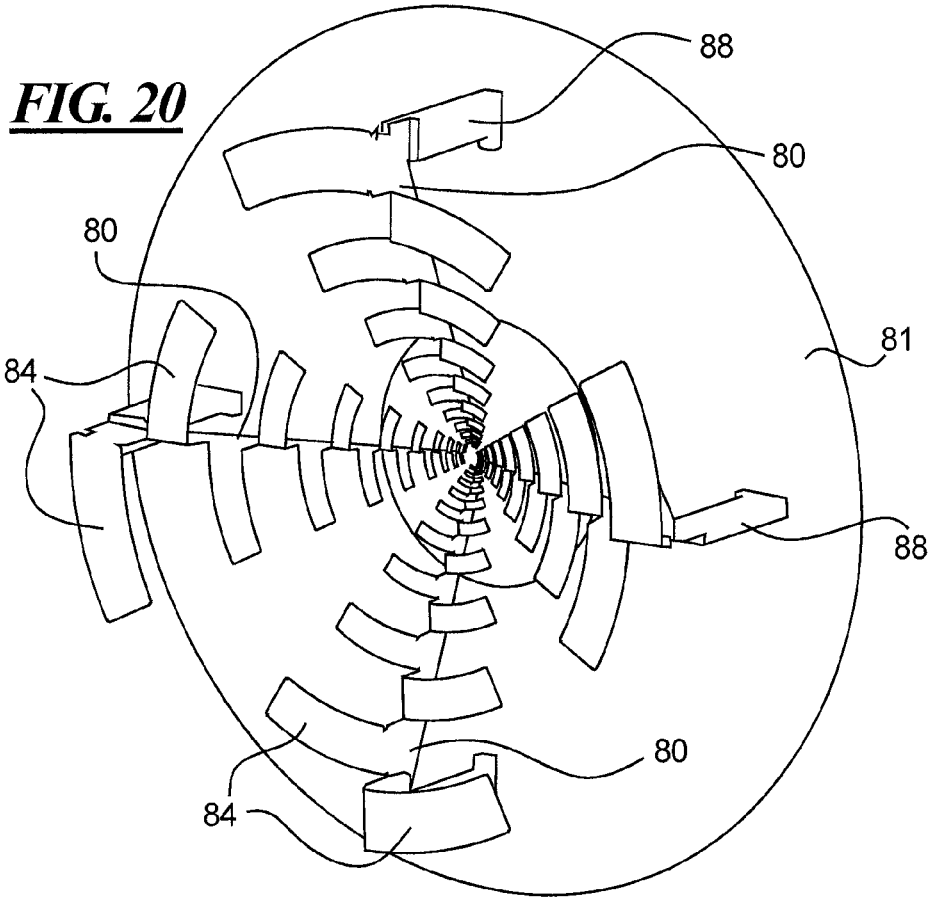
FIG. 20 is a perspective view of another alternative embodiment of an antenna fabricated in accordance with the teachings of the disclosure; and, FIG. 21 is a graph showing measured performance of the antenna of FIG. 20 in terms of VSWR with respect to frequency response.
Figure 21:
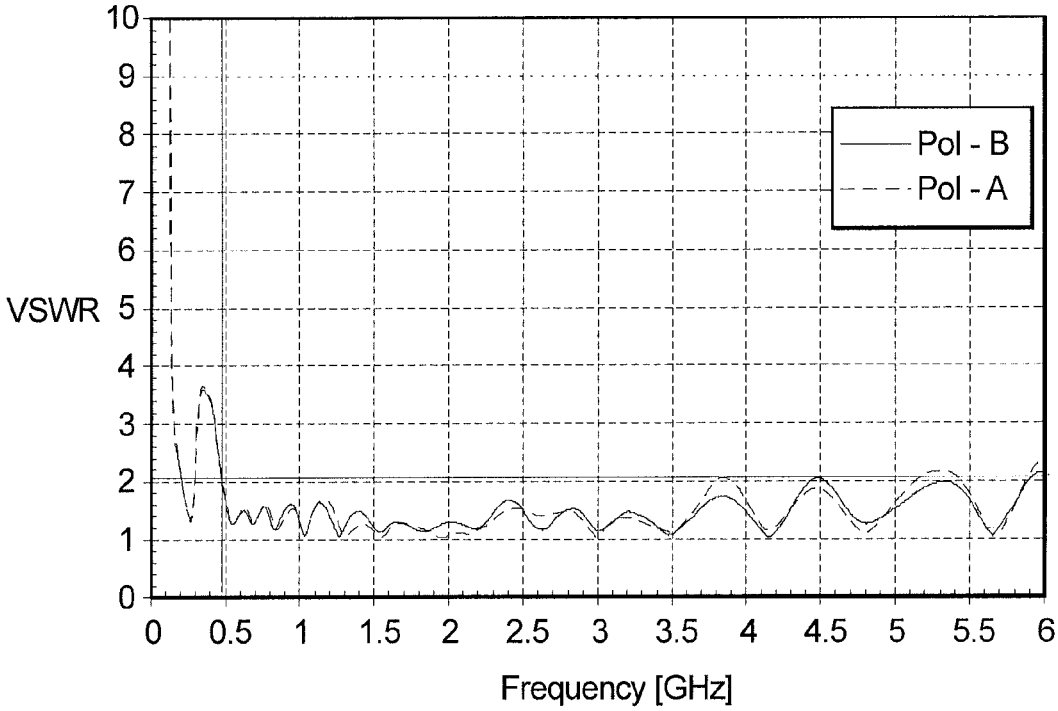

In accordance with the teachings of the disclosure, the exemplary embodiment of FIG. 20 may be fabricated. The structure of FIG. 20 is substantially similar to the previously disclosed embodiments, and more particularly to the antenna of FIG. 11. Specifically, the embodiment of FIG. 20 may include a plurality of stepped circular fingers 84 extending radially outwardly from the center of a conducting disk 81. In contrast to the bent feed veins 70 of FIG. 11, the vertical feed veins 80 of FIG. 20 may be straight and normal to the conducting disk 81. As with previous embodiments, the stepped circular fingers 84 and vertical feed veins 80 may be formed with a conducting laminate of a given thickness. Stands 88 may also be provided to support the vertical feed veins 80 on the conducting disk 81. The measured VSWR response of the antenna is provided in FIG. 21 in two polarizations with a normalizing impedance of 270Ω.

From the foregoing, it can be seen that a novel low profile non-planar ultra-wide band quasi self-complementary feed antenna is disclosed. Such an antenna may be used, for example, as a prime focus feed for a single reflector system for satellite communication, a very low noise ultra-wide band radio astronomy receiver system, a secondary focus feed for a matched object reflector antenna system for communications, a wide angle stand-alone feed for communications, or an antenna element for an array of ultra-wide band radio astronomy or communication systems.

What is claimed is:

1. A low profile and compact non-planar ultra-wide band antenna, comprising:

a conducting disk having a diameter that is dependent on an operating frequency of the ultra-wide band antenna;

a plurality of feed veins extending radially outward from a center of the conducting disk, each feed vein increasing in cross-sectional size in the radial direction, each feed vein being disposed relative to the conducting disk at an inclination angle configured to minimize cross-polarization; and a plurality of fingers extending from each feed vein from alternating sides of the feed vein.

2. The low profile antenna as described in claim 1, wherein the phase center location is frequency invariant over the operating frequency band.

3. The antenna as described in claim 1, wherein the average cross-polarization peak values are better than −10 dB over the operating frequency band.

4. The antenna as described in claim 1, wherein input return losses are better than 10 dB over the bandwidth.

5. The antenna as described in claim 1, wherein single polarization is achieved by exciting two opposing feed veins.

6. The antenna as described in claim 1, wherein dual polarization is achieved by exciting in pairs two opposing feed veins.

7. The antenna as described in claim 1, wherein the antenna has four-fold azimuth symmetry.

8. The antenna as described in claim 1, wherein the conducting disk has a diameter to height ratio of approximately 1.2 λmax to 0.25 λmax, where λmax is the maximum wavelength at the lowest operating frequency.

9. The antenna as described in claim 1, wherein the feed veins and the fingers create a three-dimensional log periodic configuration.

10. The antenna as described in claim 1, wherein the feed veins and fingers have quadratic cross-sections.

11. The antenna as described in claim 1, wherein the feed veins and the fingers have rectilinear cross-sections.

12. The antenna as described in claim 1, wherein the feed veins and fingers are laminated.

13. The antenna as described in claim 12, wherein the largest section of each finger is within the same plane of the feed vein attached thereto.

14. The antenna as described in claim 1, wherein the largest section of each finger is parallel to the conducting disk.

15. The antenna as described in claim 1, wherein the feed veins have step forming bends.

16. The antenna as described in claim 1, wherein the fingers are stepped circular fingers.

17. The antenna as described in claim 1, wherein the fingers are stepped straight fingers.

18. The antenna as described in claim 1, wherein the fingers are interleaved.

19. A low profile non-planar ultra-wide band antenna with a phase center location invariant to frequency, comprising:

a conducting disk having a diameter that is dependent on an operating frequency of the ultra-wide band antenna;

a plurality of feed veins extending radially outward from a center of the conducting disk, each feed vein increasing in cross-sectional size in the radial direction, each feed vein being disposed relative to the conducting disk at an inclination angle configured to minimize cross-polarization; and a plurality of fingers extending from each feed vein from alternating sides of the feed vein.

20. A low profile and compact non-planar ultra-wide band antenna, comprising:

a conducting disk with a diameter that is approximately 1.2 λmax, where λmax is the wavelength at the lowest operating frequency of the ultra-wide band antenna;

a plurality of feed veins radially extending outward from the center of the conducting disk inclined at an angle creating an antenna height of approximately 0.25 λmax, where λmax is the wavelength at the lowest operating frequency, the inclination angle being configured to minimize cross-polarization; and a plurality of fingers extending from each feed vein from alternating sides of the feed vein.

21. A low profile non-planar ultra-wide band antenna with input matching better than −11 dB over a decade of frequency bandwidth, comprising:

a conducting disk having a diameter that is dependent on an operating frequency of the ultra-wide band antenna;

a plurality of feed veins radially extending outward from the center of the conducting disk allowing return currents for better input matching over the frequency band, each feed vein being disposed relative to the conducting disk at an inclination angle configured to minimize cross-polarization; and a plurality of fingers extending from each feed vein from alternating sides of the feed vein.

* * * * *